US008171955B2

(12) United States Patent
David et al.

(10) Patent No.: US 8,171,955 B2
(45) Date of Patent: May 8, 2012

(54) EMERGENCY RELIEF VENT FOR FUEL STORAGE TANKS

(75) Inventors: Donald R. David, Raytown, MO (US); Ronald W. Borst, Grain Valley, MO (US); George A. Borst, Kansas City, MO (US); Gabriel R. Rodriguez, Blue Springs, MO (US)

(73) Assignee: Clay and Bailey Manufacturing Company, Kansas City, MO (US)

( * ) Notice: Subject to any disclaimer, the term of this patent is extended or adjusted under 35 U.S.C. 154(b) by 907 days.

(21) Appl. No.: 12/140,982

(22) Filed: Jun. 17, 2008

(65) Prior Publication Data

US 2009/0308877 A1 Dec. 17, 2009

(51) Int. Cl.
*F16K 15/00* (2006.01)

(52) U.S. Cl. ..... 137/543.15; 137/550; 220/89.1; 220/745

(58) Field of Classification Search ..... 137/541, 137/542, 538, 543.15, 550, 544; 220/89.1, 220/372, 567.2, 745, 565
See application file for complete search history.

(56) References Cited

U.S. PATENT DOCUMENTS

| | | | | | |
|---|---|---|---|---|---|
| 2,821,991 | A * | 2/1958 | Marx | 137/73 |
| 2,886,054 | A * | 5/1959 | Smith et al. | 137/316 |
| 3,008,485 | A * | 11/1961 | Johnson et al. | 137/541 |
| 3,811,006 | A * | 5/1974 | Burnell et al. | 174/135 |
| 4,246,930 | A * | 1/1981 | Bishop et al. | 137/493.9 |
| 4,276,901 | A * | 7/1981 | Lyons | 137/469 |
| 4,388,940 | A * | 6/1983 | Powell | 137/70 |
| 4,431,023 | A * | 2/1984 | Johnson | 137/316 |
| 4,674,530 | A * | 6/1987 | Bickford | 137/469 |
| 5,971,016 | A * | 10/1999 | Wass et al. | 137/541 |
| 6,187,182 | B1 * | 2/2001 | Reynolds et al. | 210/136 |
| 2003/0188784 | A1 * | 10/2003 | Schimnowski et al. | 137/541 |
| 2007/0157972 | A1 * | 7/2007 | Hendey | 137/541 |
| 2009/0301584 | A1 * | 12/2009 | Mckee | 137/541 |

OTHER PUBLICATIONS

Drawing No. 0354-02-2000—Clay and Bailey Mfg. Co. 2" Male Emergency Vent, Nov. 4, 1996.

* cited by examiner

*Primary Examiner* — Craig Schneider
*Assistant Examiner* — Matthew W Jellett
(74) *Attorney, Agent, or Firm* — Hovey Williams LLP

(57) ABSTRACT

A relief vent assembly for a fuel storage tank includes a vent body defining a chamber to provide a substantially axially smooth and unencumbered path of flow for pressurized fluid to vent out from the tank. Such a path of flow allows the pressurized fluid to remain laminar throughout approximately the entire path through the chamber, maintaining a high flow rate. The vent assembly includes a crossbar that supports the rod of a lid that covers a distal margin of the vent body. The crossbar is disposed substantially at the distal margin of the vent body to prevent any premature turbulent flow of the pressurized fluid, which would slow the flow rate. A widening tapered bore of the chamber increases the flow area and serves to offset the area occupied by the crossbar.

38 Claims, 7 Drawing Sheets

EMERGENCY RELIEF VENT FOR FUEL STORAGE TANKS

TECHNICAL FIELD

The present invention relates generally to fuel storage tanks and relief vents for such tanks. More particularly, the present invention concerns a relief vent assembly for a fuel storage tank that allows for rapid discharge of pressurized fluid through the vent and out of the tank when the pressure within the tank exceeds a selected level that is greater than the pressure outside the tank.

BACKGROUND

Fuel storage tanks, such as shallow tanks commonly used to hold fuel for a backup electrical generator, include a relief vent assembly that allows pressurized fluid to escape from the tank when a buildup of pressure within the tank exceeds a selected level that is greater than the pressure outside the tank. Often, these tanks are located above the ground and frequently include an inner tank that holds the fuel and an outer tank that acts as a safety vessel by containing the fuel from the inner tank should the structure of the inner tank be compromised. As such tanks normally hold fuel in liquid form, they tend not to be designed to hold a highly pressurized fluid. Thus, the relief vent assembly allows a buildup of pressurized fluid, when such condition arises, to discharge from the tank and reduce stress on the structure of the tank.

Typically, such an increase in pressure within the tank is due to an increase in heat in the area surrounding the tank, often by a fire. In order to prevent damage from rapid expansion of the pressurized fluid pushing against the structure of the tank, the vent assembly must allow this pressurized fluid to be discharged safely from the tank. Preferably, this venting occurs at a flow rate high enough to ensure that the pressure within the tank can be maintained at a manageable level.

Inasmuch as the vent assembly includes a passage from inside the tank to the outside atmosphere, a lid is customarily included such that, under normal operating conditions, the lid keeps the vent closed and maintains the inside of the tank substantially closed off from the atmosphere for various reasons. Accordingly, in addition to allowing pressurized fluid to vent out from the tank, the vent assembly should also prevent foreign matter from entering the tank. A short stroke lid is often used to accommodate the frequently limited space constraints around the fuel tank as well as to prevent foreign matter from entering the tank, including such things as contaminants or unauthorized devices used to syphon fuel from the tank.

Conventionally, a gravity closing vent has been used with these types of fuel tank systems. Such a vent provides satisfactory performance in some respects, although those of ordinary skill in the art will recognize that a gravity closing lid must be in a vertical orientation in order to function properly, limiting design options for placement on a tank. Additionally, prior art gravity closing vent assemblies have presented a stepped bore with a large and axially centrally located crossbar for supporting the lid. This crossbar introduces turbulence to the flow of the fluid in the chamber of the vent before the fluid has passed substantially through the vent, causing the fluid flow to slow down and limiting the maximum flow rate through the vent and out of the tank. Slowed flow rate is undesirable, as it can impede evacuation of pressurized fluid from the tank during emergency vent situations.

High flow rates of the pressurized fluid are advantageous, as a quick evacuation of pressurized fluid is desired in emergency situations. Furthermore, the popular certification organization Underwriters Laboratories ("UL") requires, in order to receive certification, that a vent be able to provide a flow rate of 110,000 cubic feet per hour at two and a half pounds per square inch of pressure for a four inch open pipe. Some prior art gravity closing vents have been unable to meet this threshold and, consequently, have not qualified for a commercially advantageous UL certification.

SUMMARY

The present invention provides a relief vent assembly for a fuel storage tank that allows pressurized fluid to rapidly discharge out from the tank when the pressure within the tank exceeds a selected level that is greater than the pressure outside the tank. The relief vent assembly provides a flow path through a chamber of the vent body that is substantially smooth and unencumbered, ensuring that the flow of pressurized fluid remains laminar throughout approximately the entire path. This prevents the fluid from becoming turbulent, which would detrimentally slow the flow rate through the chamber and out of the vent. The vent includes a crossbar that supports a rod of a lid that covers a distal margin of the vent body when the vent is closed. The crossbar is disposed substantially at the distal margin of the vent body to prevent any premature turbulent flow of the pressurized fluid, providing improved flow out of the tank.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWINGS

A preferred embodiment of the present invention is described in detail below with reference to the attached drawing figures, wherein.

Figure 1:
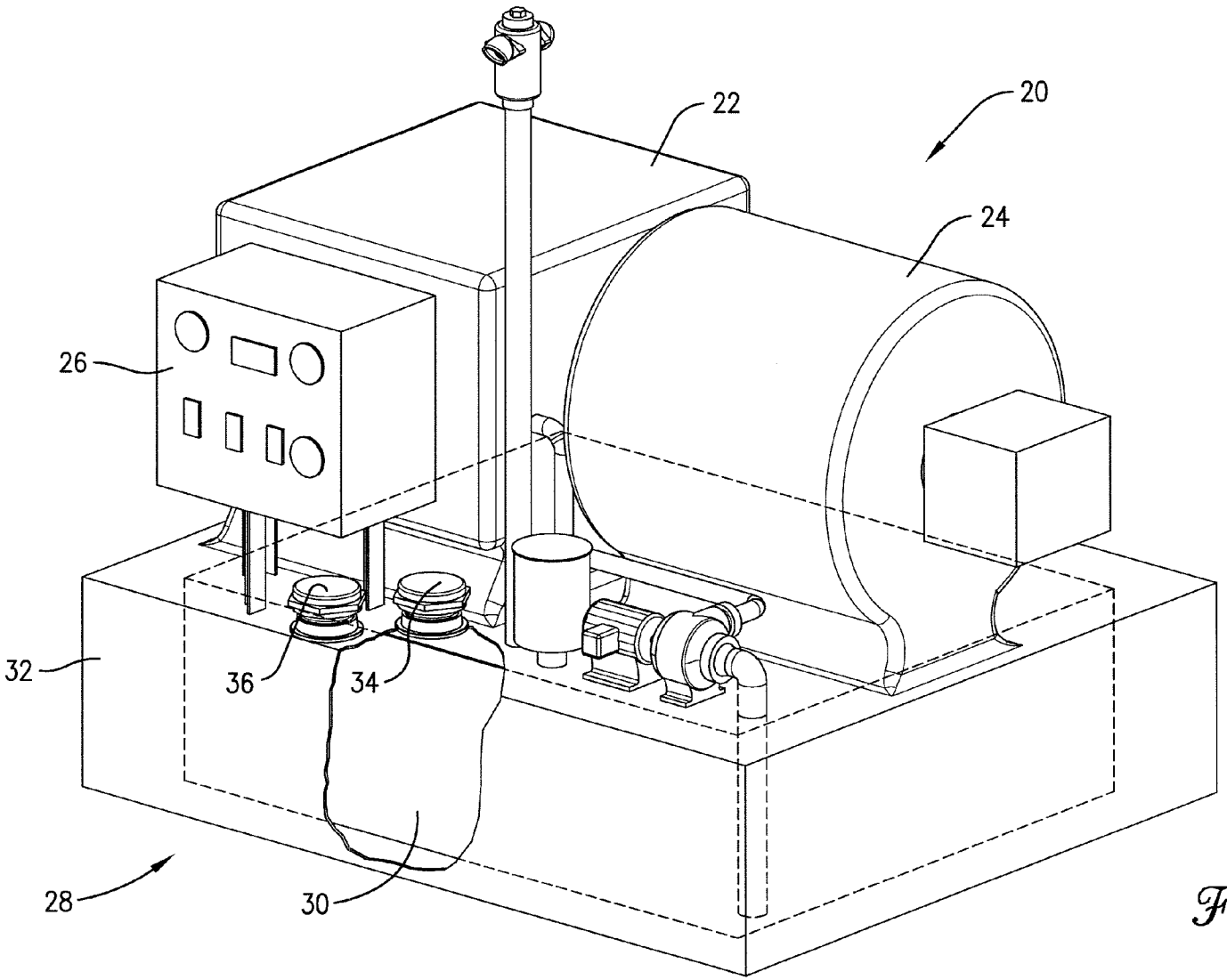
FIG. 1 is a perspective view on a reduced scale of an electrical power generation assembly constructed in accordance with the principles of the present invention, broadly including a generator, an engine, and a fuel tank assembly with an outer tank shown in solid lines and an inner tank disposed within the outer tank shown in broken lines, wherein both the outer and inner tanks include a relief vent assembly.
Figure 2:
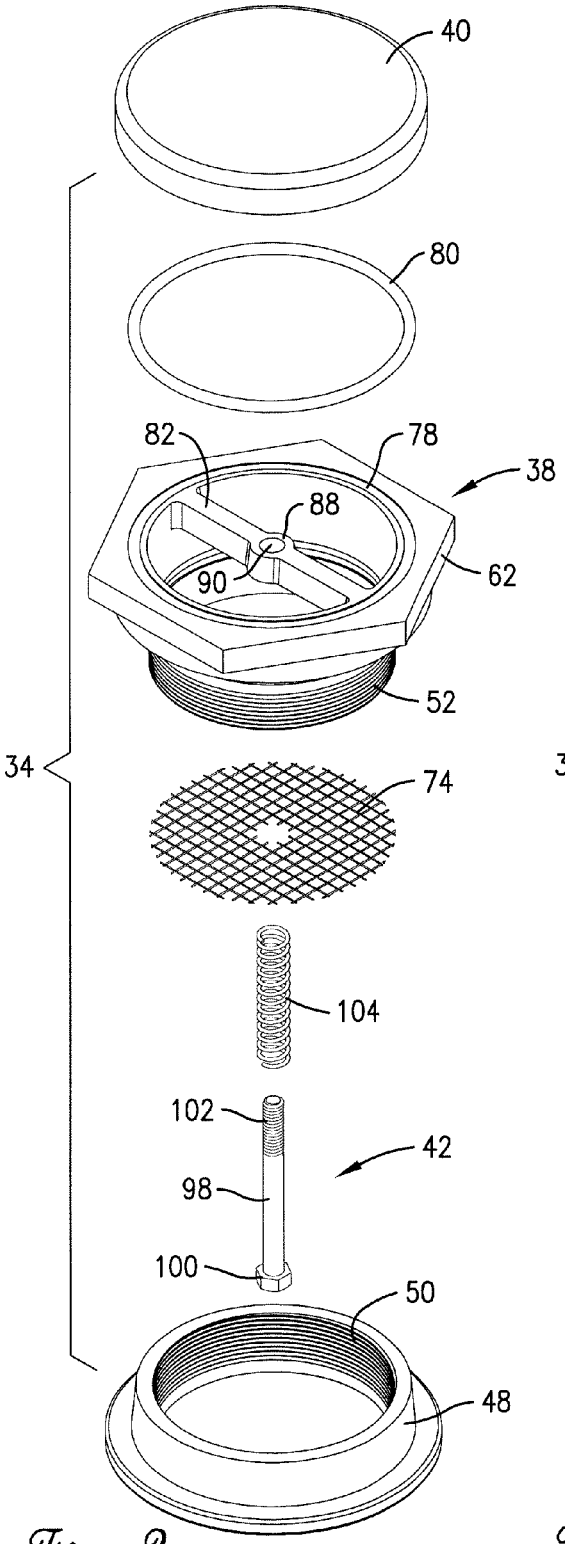
FIG. 2 is an exploded perspective view of the relief vent assembly of FIG. 1, depicting in detail the multiple components of the vent assembly from a generally top front vantage point.
Figure 3:
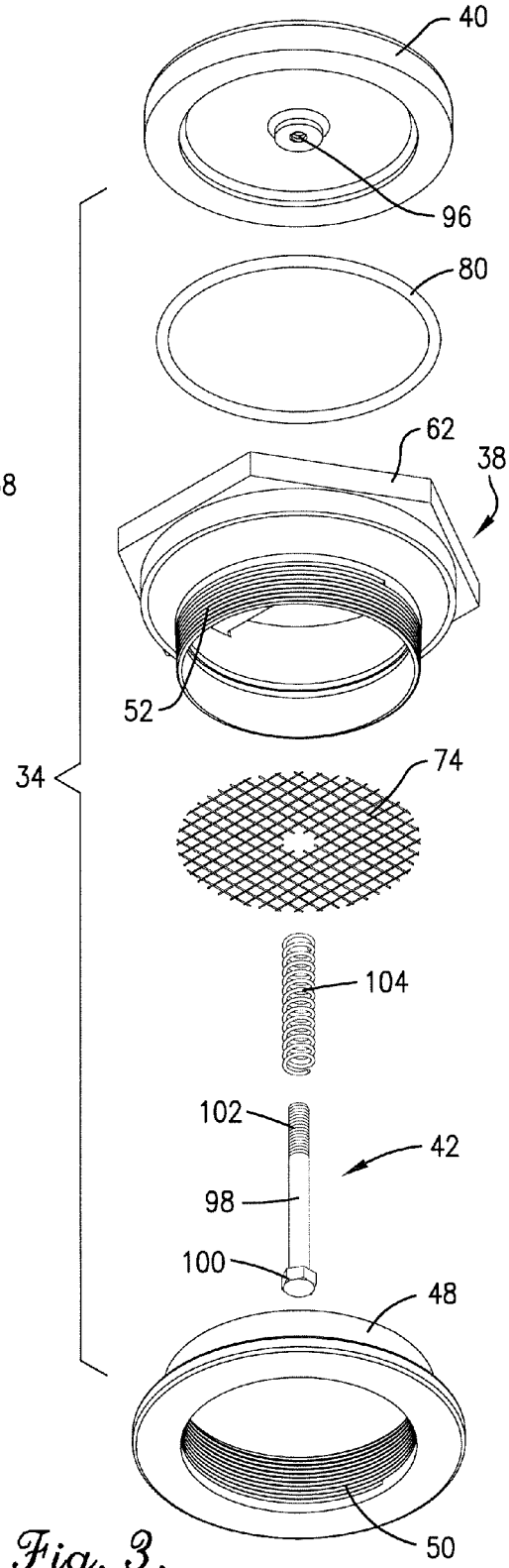
FIG. 3 is an exploded perspective view of the relief vent assembly of FIG. 1, depicting in detail the multiple components of the vent assembly, similar in many respects to FIG. 2, but illustrating the components from a generally bottom front vantage point.
Figure 4:
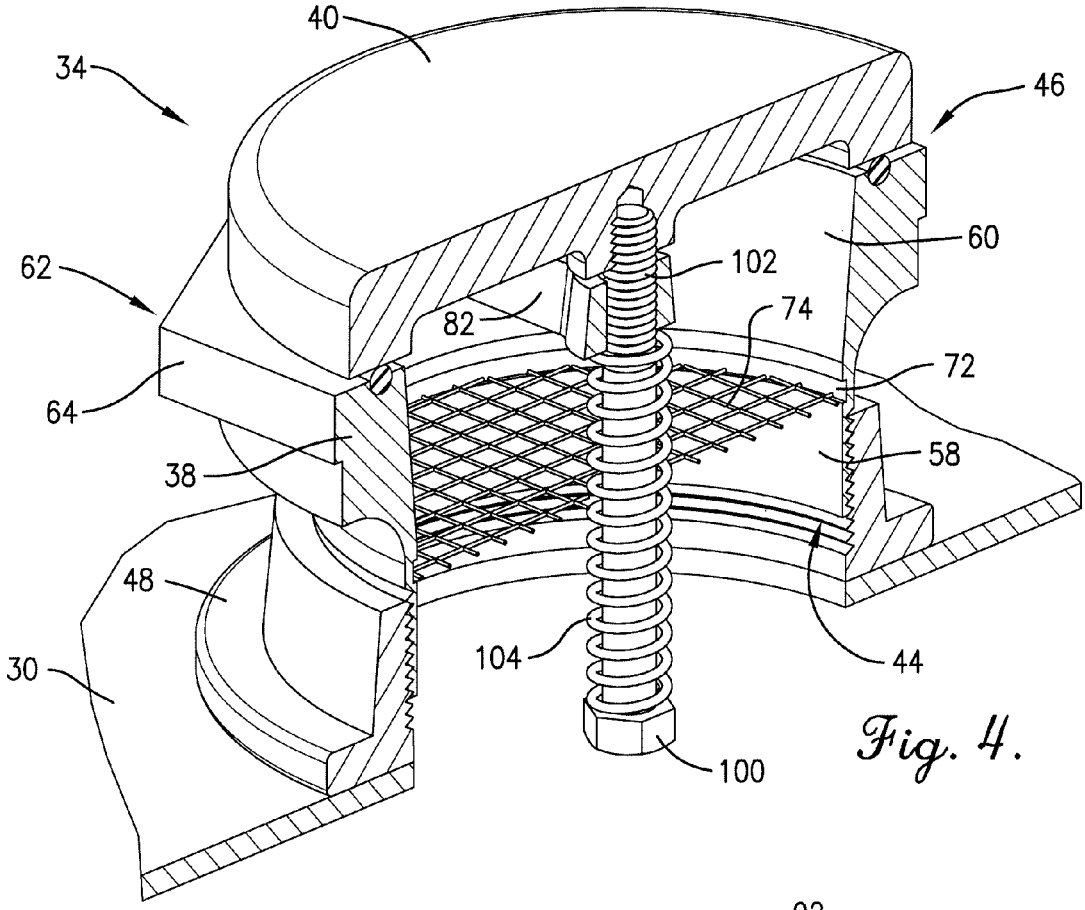
FIG. 4 is an enlarged, fragmentary, partial cutaway perspective view of the relief vent assembly, depicting in detail the multiple components thereof.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

With initial reference to FIG. 1, a backup generator assembly 20, depicted by way of example, broadly includes a diesel engine (not shown) located in a housing 22 that powers an electrical generator 24, as will be readily understood by one of ordinary skill in the art. A control box 26 is mounted to engine housing 22 to facilitate control of operating parameters for backup generator assembly 20. Fuel for the engine (not shown) is stored in a tank assembly 28.

Tank assembly 28 broadly includes an inner tank 30 that contains liquid fuel and an outer tank 32 that contains inner tank 30. As is known in the art, the inclusion of multiple tanks in the arrangement of tank assembly 28 allows outer tank 32 to act as a safety vessel, containing the liquid fuel in the event of any structural damage to inner tank 30. The depicted tanks 30 and 32 are shallow, above-ground tanks, although the principles of the present invention may also be applied to other types of liquid fuel tanks.

Inner tank 30 is substantially sealed and includes a relief vent assembly 34 that allows pressurized fluid to vent from tank 30 when a buildup of pressure within tank 30 is such that the pressure within tank 30 exceeds a selected level that is greater than the pressure outside tank 30. Relief vent assembly 34 provides for rapid evacuation of pressurized fluid from tank 30 during emergency situations, such as a significant increase in pressure within tank 30 due to an increase in heat in the area surrounding tank assembly 28, as may be caused by a fire.

Outer tank 32 includes a relief vent assembly 36 that functions similarly to vent assembly 34 and allows pressurized fluid to vent from tank 32 when there is pressurized fluid in outer tank 32. In the embodiment depicted, vent assembly 34 and vent assembly 36 are structurally identical, although such conformity is not necessary, as will be readily appreciated by one of ordinary skill in the art. While only vent assembly 34 will be described in greater detail below, it is to be understood that the details of construction for vent assembly 34 also apply to vent assembly 36 in the embodiment of tank assembly 28 depicted in FIG. 1.

With reference now to FIGS. 2-6*a*, vent assembly 34 is depicted in greater detail, showing details of construction of the component parts thereof. Vent assembly 34 broadly includes a vent body 38, a shiftable lid 40, and a rod 42. Only vent assembly 34 of inner tank 30 will be described in greater detail herein, with the understanding that the details of construction of vent assembly 34 also apply to vent assembly 36 of outer tank 32.

Vent body 38 is generally annularly shaped and includes an axially proximal margin 44 and an axially distal margin 46. Axially proximal margin 44 of vent body 38 is configured for threaded receipt within a receiving flange 48 fixed to the top wall of tank 30. In the illustrated embodiment, flange 48 presents a diameter of approximately four inches, although other size flanges and associated vent bodies could be similarly used without departing from the teachings of the present invention. Flange 48 protrudes outward from tank 30 and includes internal threads 50. Axially proximal margin 44 of vent body 38 includes a threaded portion 52 that threadably secures vent assembly 34 within flange 48. Threaded portion 52 extends from an axially proximal end 52*a* up to an axially distal end 52*b*. While the illustrated embodiment depicts flange 48 protruding upwardly from the top of tank 30, alternative dispositions for a flange (such as on the side of a tank) are within the ambit of the present invention, as will be appreciated by one of ordinary skill in the art upon review of this disclosure.

Vent body 38 includes a radially inner wall surface 54 and a radially outer surface 56. Inner wall surface 54 includes a constant diameter portion 58 that extends axially upwardly from proximal margin 44. Inner wall surface 54 also includes a tapered bore portion 60 that extends axially upwardly from constant diameter inner wall portion 58 to distal margin 46 of vent body 38. Tapered bore portion 60 of inner wall 54 presents a diameter that increases smoothly and continuously from the diameter of constant diameter portion 58 to a larger diameter at axially distal margin 46.

Radially outer surface 56 includes a noncircular portion 62 that is configured such that a tool can be used to twist vent body 38 to secure vent body 38 to flange 48 of tank 30, as will be readily appreciated by one of ordinary skill in the art. Depicted noncircular portion 62 comprises a plurality of flat faces 64, some of which can be engaged with a wrench, although it is clearly within the ambit of the present invention to include more or fewer flat faces (or even shapes that are other than polygonal) for an alternative noncircular portion.

A thread 66 of threaded portion 52 of vent body 38 includes a radially innermost thread root 68 and a radially outermost thread crest 70. As shown particularly in the enlarged view of FIG. 6*a*, the radial distance between constant diameter inner wall portion 58 and thread root 68 is less than the radial distance between thread root 68 and thread crest 70. This thin wall section of vent body 38 defines a diameter of constant diameter inner wall portion 58 of vent body 38 that is nearly as large as the diameter of flange 48 itself, providing a relatively large area through which pressurized fluid can flow through vent body 38 and out of vent assembly 34.

Returning now to radially inner wall surface 54 of vent body 38, a radially extending groove 72 is defined in wall surface 54. Groove 72 is disposed between constant diameter portion 58 and tapered bore portion 60, such that constant diameter portion 58 is below groove 72 and tapered bore portion 60 is above groove 72. A screen 74 is disposed within groove 72 to prevent the introduction of foreign matter through vent body 38 and into tank 30, as will be readily appreciated by one of ordinary skill in the art upon review of this disclosure. Accordingly, screen 74 helps to both prevent contamination and deter theft of the contents of tank 30.

Axially distal margin 46 of vent body 38 includes a generally flat top face 76. Top face 76 includes an axially extending groove 78 defined therein and extending in a circle. A seal 80 is disposed at least partially within groove 78 to cooperate with lid 40, as described in greater detail below. To this end, at least a portion of seal 80 extends out of groove 78 and above top face 76 of vent body 38.

Vent body 38 also includes a crossbar 82 that spans the diameter of vent body 38 along distal margin 46 thereof. Crossbar 82 includes an axially distal portion presented by a top surface 84 and an axially proximal portion presented by a bottom surface 86. Top surface 84 of crossbar 82 is coplanar with top face 76 of vent body 38. The disposition of crossbar 82 adjacent axially distal margin 46 of vent body 38 provides a largely unencumbered area within the chamber of vent body 38 such that fluid can flow through vent body 38 (from proximal margin 44 to distal margin 46) with minimal interference, as will be described in greater detail below. As shown particularly in FIG. 2, crossbar 82 also includes a generally centrally disposed enlarged portion 88 with an axial hole 90 defined therethrough. Hole 90 extends from top surface 84 to bottom surface 86.

Figure 5:
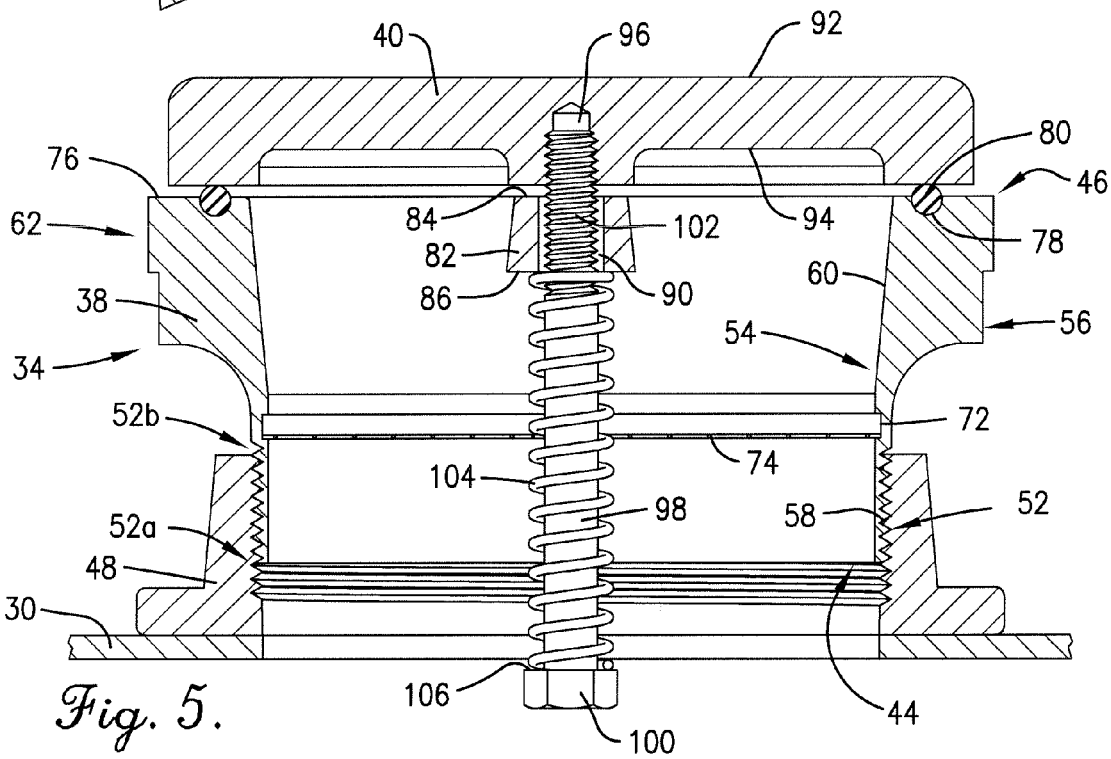
FIG. 5 is a fragmentary, partial side sectional view of the relief vent assembly shown in FIG. 4, depicting the multiple components thereof and the shape of the chamber, with the assembly depicted with the lid in a closed position.
Figure 6:
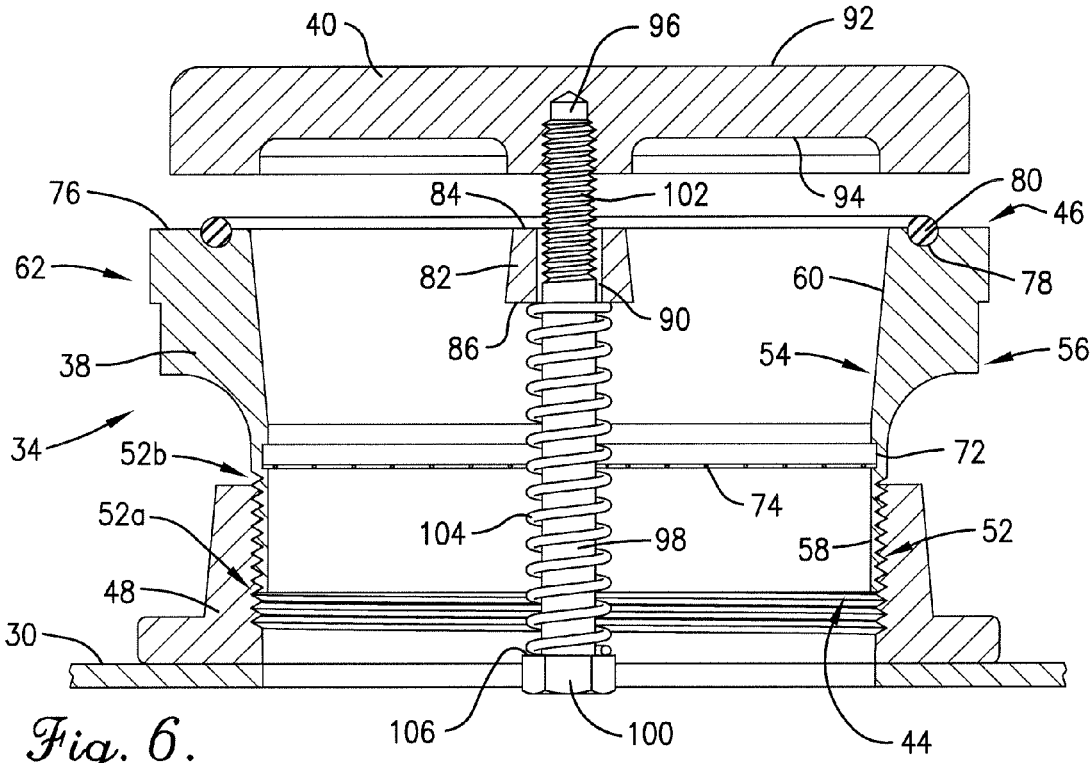
FIG. 6 is a fragmentary, partial side sectional view of the relief vent assembly shown in FIG. 4, depicting the multiple components thereof and the shape of the chamber, similar in many respects to FIG. 5, but with the assembly depicted with the lid in an open position.
Figure 6A:
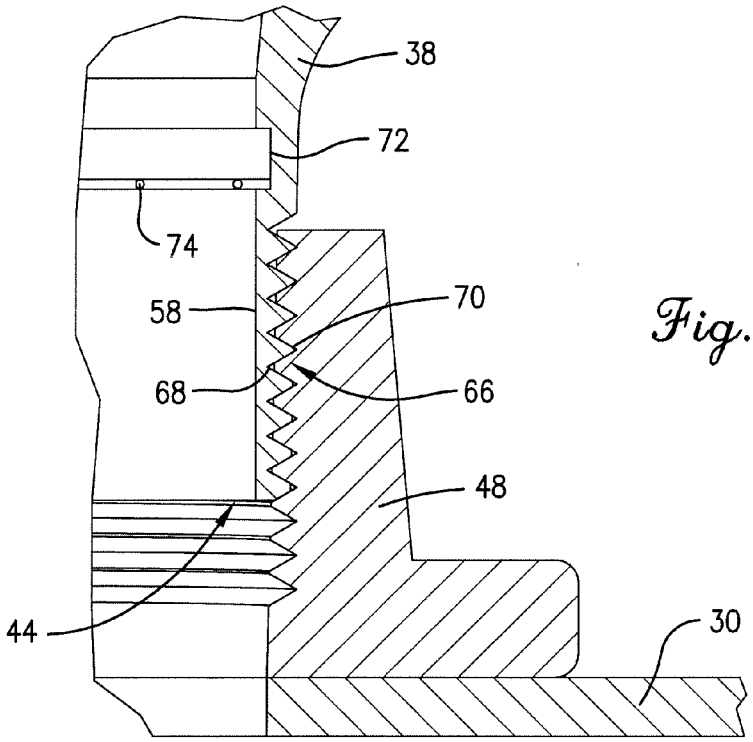
FIG. 6*a* is an enlarged, fragmentary, partial side sectional view of a portion of the relief vent assembly shown in FIG. 6, depicting in detail an externally threaded portion of the vent body received within a correspondingly threaded flange of the tank.

Lid 40 generally surmounts vent body 38 and is shiftable between a closed position (shown in FIG. 5) and an open position (shown in FIG. 6). Lid 40 includes an outside top surface 92 and an inside bottom surface 94. A portion of inside bottom surface 94 cooperates with seal 80 to substantially close vent assembly 34. A centrally disposed threaded recess 96 extends upwardly from bottom surface 94 of lid 40. Threaded recess 96 is coaxial with hole 90 through crossbar 82 when lid 40 is disposed in surmounting relationship with vent body 38.

Rod 42 generally supports and defines the path of travel for lid 40 by cooperating with structure of vent body 38. In particular, rod 42 extends downwardly from bottom surface 94 of lid 40 and through hole 90 in crossbar 82, such that crossbar 82 radially supports rod 42. Depicted rod 42 comprises a bolt that includes a shaft 98, a head 100 at the proximal end of shaft 98, and a threaded portion 102 at the distal end of shaft 98. In assembled vent assembly 34, rod 42 extends upwardly within vent body 38, through hole 90 in crossbar 82, and into threaded recess 96 in lid 40. Threaded portion 102 of rod 42 is thereby threadably secured to lid 42, as shown particularly in FIGS. 5 and 6.

With continued reference to FIGS. 5 and 6, a spring 104 is axially aligned with and disposed around shaft 98 of rod 42. In assembled vent assembly 34, one end of spring 104 engages bottom surface 86 of crossbar 82 and the other end of spring 104 engages an engagement surface 106 of head 100 of rod 42. As will be readily appreciated by one of ordinary skill in the art upon review of this disclosure, the extension force of spring 104 biases lid 40 toward the closed position (shown in FIG. 5).

The general operation of vent assembly 34 should be apparent to one of ordinary skill in the art from the foregoing description and, therefore, will be described here only briefly. Fuel is stored in inner tank 30 and vent assembly 34 is secured to flange 48 of tank 30. Under normal operating conditions, the fuel in tank 30 is stored in liquid form and vent assembly 34 maintains separation between the contents of tank 30 and the outside environment with lid 40 in the closed position (shown in FIG. 5). Upon a condition of a buildup of pressurized fluid within tank 30, such as may occur during an increase in heat in the area surrounding tank 30, some of the pressurized fluid discharges from tank 30 through vent assembly 34.

As the pressure within tank 30 increases, a force is exerted on bottom surface 94 of lid 40, which compresses spring 104, and moves lid 40 from a closed position to an open position (shown in FIG. 6). When lid 40 is open, the pressurized fluid vents from inside tank 30 to the outside environment, relieving pressure buildup within tank 30. The structure of relief vent assembly 34 provides a flow path through vent body 38 that is substantially smooth and unencumbered.

The structure of the present invention ensures that the flow of pressurized fluid remains laminar and prevents the venting fluid from becoming turbulent, which would slow the flow rate through vent body 38 and out of vent assembly 34. Maintaining a laminar flow of the venting fluid provides a more rapid evacuation of the pressurized fluid from tank 30, which is particularly advantageous during emergency situations, such as when the pressure buildup is rapid and/or significant, as when a fire increases the heat in the area surrounding tank assembly 28.

In the illustrated embodiment, crossbar 82 is disposed adjacent axially distal margin 46 of vent body 38, within the area of tapered bore 60 that presents the largest diameter across the chamber of vent body 38. In this arrangement, the diminution of cross sectional area of the chamber due to the inclusion of crossbar 82 is compensated for by the enlarged diameter of the chamber due to tapered bore 60. Additionally, the disposition of crossbar 82 at distal margin 46 of vent body 38 ensures that laminar fluid flow of the venting pressurized fluid is undisturbed by the structure of crossbar 82 until such laminar flow is at distal margin 46 and ready to discharge out of vent body 38.

Such arrangement prevents the introduction of turbulence to the flow within the chamber of vent body 38, which would detrimentally slow the flow of the fluid through vent body 38 and lessen the discharge flow rate out of vent body 38. This configuration provides a sufficiently high discharge flow rate that vent assembly 34 of the present invention meets the UL certification threshold of discharging 110,000 cubic feet per hour at two and a half pounds per square inch of pressure for a four inch open pipe that some prior art units have been unable to meet.

Figure 7:
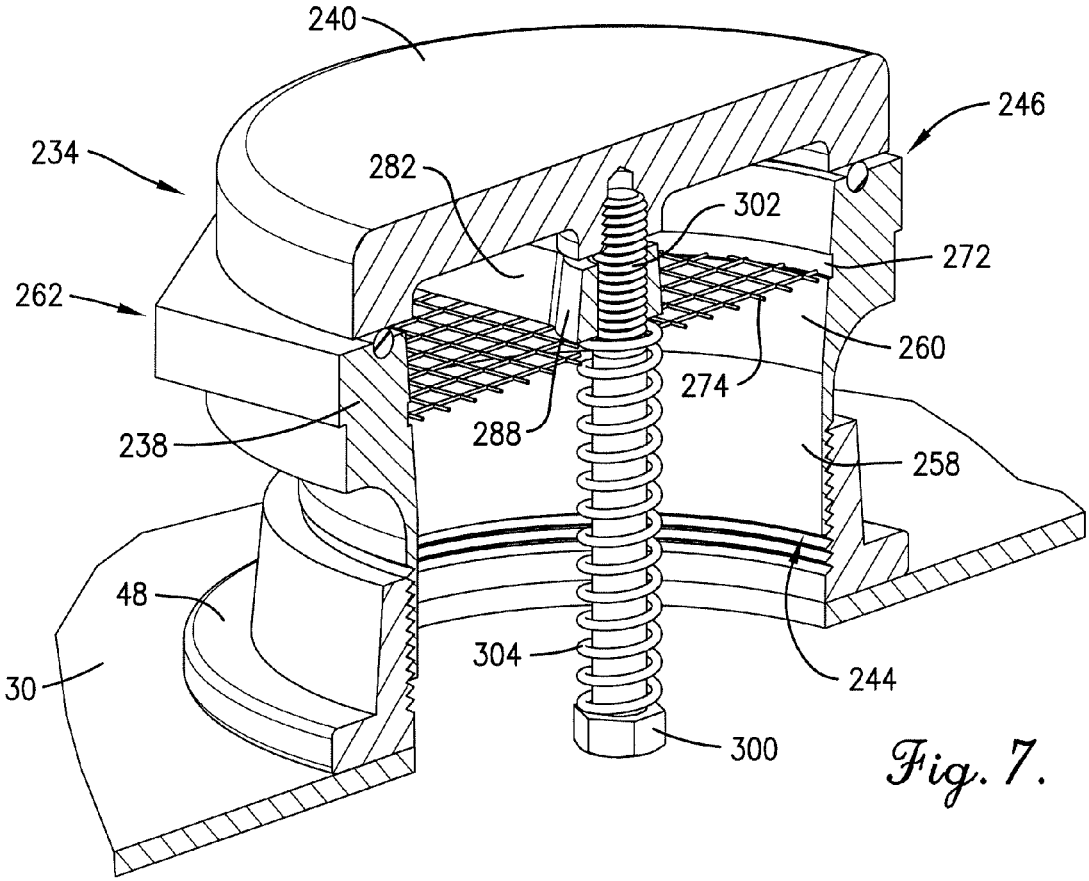
FIG. 7 an enlarged, fragmentary, partial cutaway perspective view of an alternative embodiment of the relief vent assembly, depicting in detail the multiple components thereof, similar in many respects to FIG. 4, but with the screen element positioned adjacent the base of the crossbar.
Figure 8:
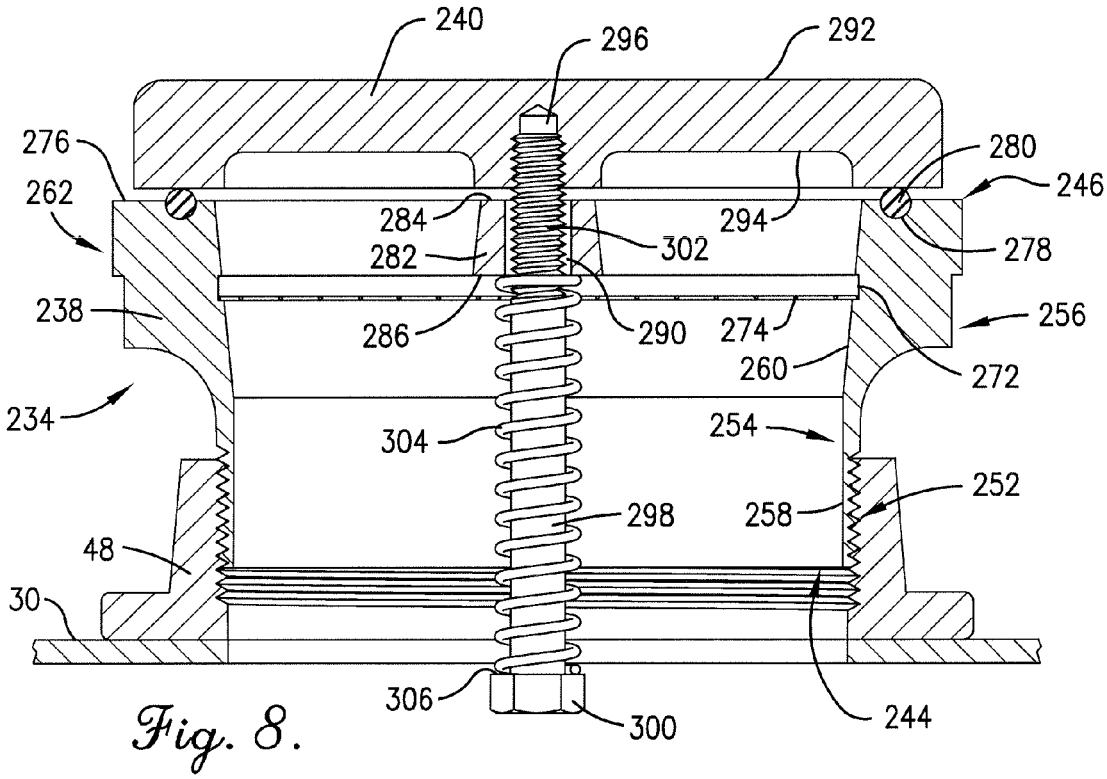
FIG. 8 is a fragmentary, partial side sectional view of the alternative embodiment of the relief vent assembly shown in FIG. 7, depicting the multiple components thereof and the shape of the chamber, with the assembly depicted with the lid in a closed position.

With reference now to FIGS. 7-8, another embodiment of a vent assembly 234 is depicted secured to threaded flange 48 of tank 30. Many of the elements and details of construction of alternative vent assembly 234 are very similar in many respects to those of vent assembly 34 discussed above. Therefore, for the sake of brevity and consistency, similar elements between vent assembly 34 and alternative vent assembly 234 are numbered in similar fashion, but differing by an order of two hundred. Additionally, only the differences between the embodiments will be discussed in detail, as the vast majority of the elements and functions will be the same between these illustrated embodiments, as will be readily apparent to one of ordinary skill in the art from the description above. Vent assembly 234 broadly includes a vent body 238, a shiftable lid 240, and a rod 242.

Vent body 238 is generally annularly shaped and includes an axially proximal margin 244 and an axially distal margin 246. Axially proximal margin 244 of vent body 238 is configured for threaded receipt within receiving flange 48 of tank 30. Axially proximal margin 244 of vent body 238 includes a threaded portion 252 that threadably secures vent assembly 234 within flange 48.

Vent body 238 includes a radially inner wall surface 254 and a radially outer surface 256. Inner wall surface 254 includes a constant diameter portion 258 that extends axially upwardly from proximal margin 244. Inner wall surface 254 also includes a tapered bore portion 260 that extends axially upwardly from constant diameter inner wall portion 258 to distal margin 246 of vent body 238. Tapered bore portion 260 of inner wall 254 presents a diameter that increases smoothly and continuously from the diameter of constant diameter portion 258 to a larger diameter at axially distal margin 246. Radially outer surface 256 includes a noncircular portion 262 that is configured such that a tool can be used to twist vent body 238 to secure the same to flange 48 of tank 30, as will be readily appreciated by one of ordinary skill in the art.

Axially distal margin 246 of vent body 238 includes a generally flat top face 276. Top face 276 includes an axially extending groove 278 defined therein and extending in a circle. A seal 280 is disposed at least partially within groove 278 to cooperate with lid 240, as described in greater detail below. To this end, at least a portion of seal 280 extends out of groove 278 and above top face 276 of vent body 238.

Vent body 238 also includes a crossbar 282 that spans the diameter of vent body 238 along distal margin 246 thereof. Crossbar 282 includes an axially distal portion presented by a top surface 284 and an axially proximal portion presented by a bottom surface 286. Top surface 284 of crossbar 282 is coplanar with top face 276 of vent body 238. The disposition of crossbar 282 adjacent axially distal margin 246 of vent body 238 provides a largely unencumbered area within the chamber of vent body 238 such that fluid can flow through vent body 238 (from proximal margin 244 to distal margin 246) with minimal interference, as described in greater detail with respect to the first embodiment above. Crossbar 282 also includes a generally centrally disposed enlarged portion 288 with an axial hole 290 defined therethrough. Hole 290 extends from top surface 284 to bottom surface 286.

Returning now to radially inner wall surface 254 of vent body 238, a radially extending groove 272 is defined in wall surface 254. In distinction to groove 72 of the first embodiment discussed above, groove 272 is disposed within tapered bore portion 260 and generally adjacent bottom surface 286 of crossbar 282. A screen 274 is disposed within groove 272 to prevent the introduction of foreign matter through vent body 238 and into tank 30, as will be readily appreciated by one of ordinary skill in the art upon review of this disclosure. Accordingly, screen 274 helps to both prevent contamination and deter theft of the contents of tank 30. In this configuration, screen 274 is disposed closer to distal margin 246 and outlet end of vent body 238 than is screen 74 of the first embodiment discussed above. More particularly, screen 274 of this alternative embodiment is disposed as close to crossbar 282 as practicable, as shown particularly in FIG. 8.

Lid 240 generally surmounts vent body 238 and is shiftable between a closed position (shown in FIG. 8) and an open position (not shown, but readily appreciated by one of ordinary skill in the art from the above description). Lid 240 includes an outside top surface 292 and an inside bottom surface 294. A portion of inside bottom surface 294 cooperates with seal 280 to substantially close vent assembly 234. A centrally disposed threaded recess 296 extends upwardly from bottom surface 294 of lid 240. Threaded recess 296 is coaxial with hole 290 through crossbar 282 when lid 240 is disposed in surmounting relationship with vent body 238.

Rod 242 generally supports and defines the path of travel for lid 240 by cooperating with structure of vent body 238. In particular, rod 242 extends downwardly from bottom surface 294 of lid 240 and through hole 290 in crossbar 282, such that crossbar 282 radially supports rod 242. Depicted rod 242 comprises a bolt that includes a shaft 298, a head 300 at the proximal end of shaft 298, and a threaded portion 302 at the distal end of shaft 298. In assembled vent assembly 234, rod 242 extends upwardly within vent body 238, through hole 290 in crossbar 282, and into threaded recess 296 in lid 240. Threaded portion 302 of rod 242 is thereby threadably secured to lid 242, as shown particularly in FIG. 8.

A spring 304 is axially aligned with and disposed around shaft 298 of rod 242. In assembled vent assembly 234, one end of spring 304 engages bottom surface 286 of crossbar 282 and the other end of spring 304 engages an engagement surface 306 of head 300 of rod 242. As will be readily appreciated by one of ordinary skill in the art upon review of this disclosure, the extension force of spring 304 biases lid 240 toward the closed position (shown in FIG. 8).

The general operation of alternative vent assembly 234 should be apparent to one of ordinary skill in the art from the foregoing description and is substantially the same as the operation of vent assembly 34, described in greater detail above. Therefore, for the sake of brevity, a redundant operational description is not presented here, but rather attention is directed to the discussion of operation of vent assembly 34, above, with the understanding that alternative disposition of groove 272 and screen 274 do not materially change the fundamental operation of alternative vent assembly 234 from that of vent assembly 34.

Figure 9:
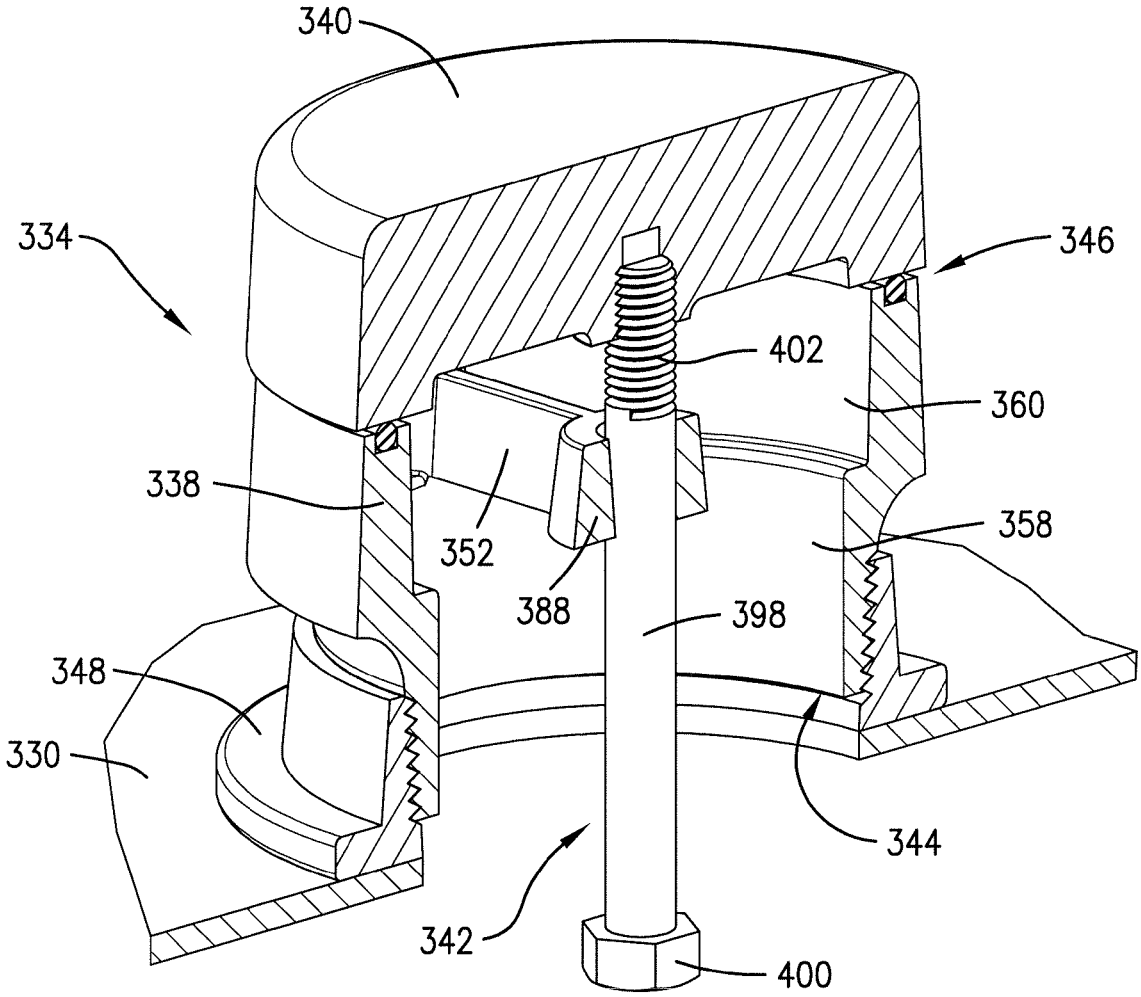
Fig. 9. PRIOR ART
FIG. 9 is a fragmentary, partial cutaway perspective view of a prior art vent assembly, depicting in detail the multiple components thereof.
Figure 10:
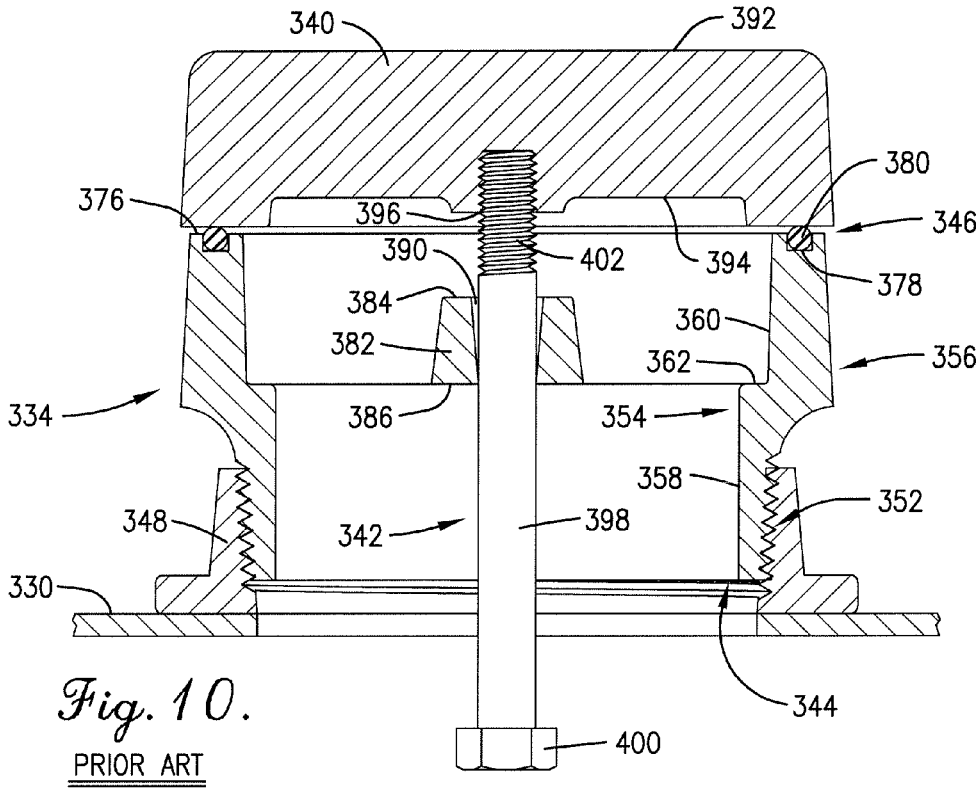
Fig. 10. PRIOR ART
FIG. 10 is a fragmentary, partial side sectional view of the prior art relief vent assembly shown in FIG. 9, depicting the multiple components thereof and the stepped bore of the chamber, with the assembly depicted with the lid in a closed position.
Figure 11:
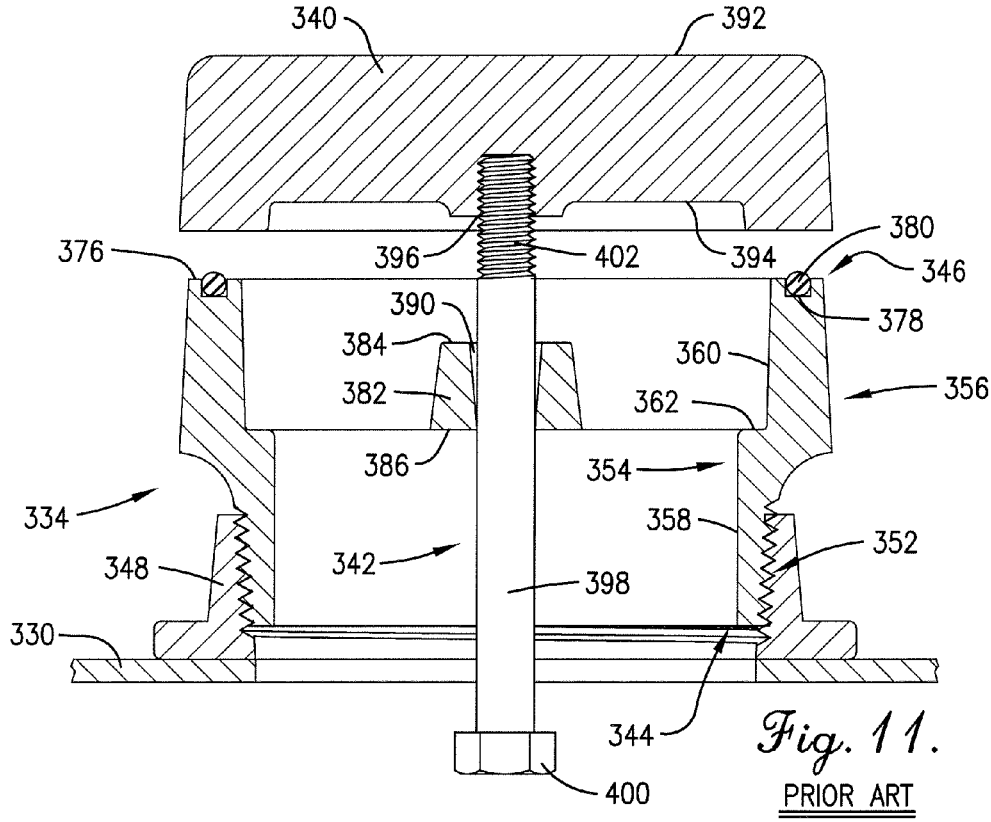
Fig. 11. PRIOR ART
FIG. 11 is a fragmentary, partial side sectional view of the prior art relief vent assembly shown in FIG. 9, depicting the multiple components thereof and the stepped bore of the chamber, similar in many respects to FIG. 10, but with the assembly depicted with the lid in an open position.

Turning briefly now to FIGS. 9-11, a prior art gravity closing vent assembly 334 that does not maintain laminar flow of the venting fluid is depicted on a tank 330. Prior art vent assembly 334 includes some components that are somewhat similar to those of vent assembly 34 discussed above. Therefore, in the interest of clarity, similar elements between vent assembly 34 and prior art vent assembly 334 are numbered similarly, but differing by an order of three hundred. Prior art vent assembly 334 broadly includes a stepped bore vent body 338, a shiftable lid 340, and a rod 342.

Prior art vent body 338 is generally annularly shaped and includes an axially proximal margin 344 and an axially distal margin 346. Axially proximal margin 344 of vent body 338 is configured for threaded receipt within a receiving flange 348 of a tank 330. Axially proximal margin 344 of vent body 338 includes a threaded portion 352 that threadably secures vent assembly 334 within flange 348.

Prior art vent body 338 includes a radially inner wall surface 354 and a radially outer surface 356. Inner wall surface 354 includes a first constant diameter portion 358 that extends axially upwardly from proximal margin 344 and a second constant diameter portion 360 that extends axially downwardly from distal margin 346. The diameter of first portion 358 is less than the diameter of second portion 360, and a horizontally extending circular lip 362 is formed at the intersection of the portions 358, 360, making inner wall surface 354 axially discontinuous.

Outer surface 356 is circular and does not include a portion that could be turned with a wrench to facilitate securement of prior art vent body 338 within flange 348. Further, the radial wall thickness of first constant diameter portion 358 is relatively thick compared to the depth of the threads on threaded portion 352, which may add structural rigidity, but limits the area through which pressurized fluid can flow through vent body 338 and out of prior art vent assembly 334.

Axially distal margin 346 of prior art vent body 338 includes a generally flat top face 376. Top face 376 includes an axially extending groove 378 defined therein and extending in a circle. A seal 380 is disposed at least partially within groove 378 to cooperate with lid 340, in a manner that will be readily understood upon a review of the foregoing description. To this end, at least a portion of seal 380 extends out of groove 378 and above top face 376 of vent body 338.

Prior art vent body 338 includes a crossbar 382 that spans the diameter of vent body 338 along an axially interior portion thereof. Crossbar 382 includes a top surface 384 and a bottom surface 386. Both top surface 382 and bottom surface 386 of crossbar 382 are disposed axially between proximal margin 344 and distal margin 346 of vent body 338 so that crossbar 382 is axially centrally disposed within vent body 338. More specifically, bottom surface 386 of crossbar 382 is radially aligned with horizontally extending circular lip 362.

Crossbar 382 also includes generally centrally disposed enlarged portion 388 with an axial hole 390 defined therethrough. Hole 390 extends from top surface 384 of crossbar 382 to bottom surface 386 of crossbar 382. Crossbar 382 does support rod 342 of lid 340, as explained in greater detail below, but the axially central disposition of crossbar 382 within vent body 338 between proximal and distal margins 344, 346 creates turbulence within the fluid as the fluid flows through vent body 338 and out of vent assembly 334. This turbulence slows the flow of the fluid and reduces the flow rate of the pressurized fluid out of vent assembly 334.

Lid 340 generally surmounts vent body 338 and is shiftable between a closed position (shown in FIG. 10) and an open position (shown in FIG. 11). Lid 340 includes an outside top surface 392 and an inside bottom surface 394. The axial thickness of lid 340 between top surface 392 and bottom surface 394 is substantial so that lid 340 is sufficiently heavy to be biased toward the closed position by the force of gravity acting on lid 340. A portion of inside bottom surface 394 cooperates with seal 380 to substantially close vent assembly 334. A centrally disposed threaded recess 396 extends upwardly from bottom surface 394 of the 340. Threaded recess 396 is coaxial with hole 390 through crossbar 382 when lid 340 is disposed in surmounting relationship with vent body 338.

Rod 342 generally supports and defines the path of travel for lid 340 by cooperating with structure of prior art vent body 338. In particular, rod 342 extends downwardly from bottom surface 394 of lid 340 and through hole 390 in crossbar 382, such that crossbar 382 radially supports rod 342. Depicted rod 342 comprises a bolt that includes a shaft 398, a head 400 at the proximal end of shaft 398, and a threaded portion 402 at the distal end of shaft 398. In assembled prior art vent assembly 334, rod 342 extends upwardly within vent body 338, through hole 390 in crossbar 382, and into threaded recess 396 in lid 340. Threaded portion 402 of rod 342 is thereby threadably secured to lid 342, as shown particularly in FIG. 10.

Some aspects of the general operation of prior art vent assembly 334 will be apparent to one of ordinary skill in the art from the foregoing description and, therefore, will not be described in detail here. It is emphasized, however, that prior art vent assembly 334, while satisfactory in some respects, includes structural differences that limit the flow rate of pressurized fluid through vent body 338. For example, the relatively thick radial wall thickness of threaded portion 352 restricts the area of vent body 338 through which pressurized fluid can flow, limiting the maximum possible flow rate. Additionally, the axially central disposition of crossbar 382 between proximal and distal margins 344, 346 and the inclusion of horizontally extending circular lip 362 of the stepped bore of vent body 338 both create turbulence within the fluid as the fluid flows through vent body 338 and out of vent assembly 334. This turbulence slows the flow of the fluid and further reduces the maximum possible flow rate of the pressurized fluid out of vent assembly 334.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and access the reasonably fair scope of the present invention as pertains to any apparatus not materially departing from but outside the literal scope of the invention set forth in the following claims.

What is claimed is:

1. A fuel storage assembly for containing fuel and allowing pressurized fluid to vent out from the assembly when the pressure within the assembly exceeds a selected level that is greater than the pressure outside the assembly, said assembly comprising:

a tank configured to hold a liquid fuel, said tank being substantially sealed and presenting an opening through which pressurized fluid can vent from inside the tank to outside the tank, said tank including an internally threaded flange around the opening;

a generally annular vent body presenting an axially proximal margin and an axially distal margin, said axially proximal margin being threadably received within the flange of the tank, said vent body defining a generally cylindrical chamber, said vent body including a supporting crossbar generally radially spanning the chamber;

a lid generally axially surmounting the axially distal margin of the vent body;

a rod projecting axially proximally from the lid, said supporting crossbar including a generally centrally disposed hole defined axially therethrough, said rod projecting through the hole in the crossbar such that the crossbar radially supports and axially aligns the rod, said crossbar including an axially distal portion that is generally coplanar with the axially distal margin of the vent body, said cylindrical chamber including a widening bore having a cross-sectional dimension that progressively increases distally, said crossbar projecting across and being located within the widening bore so as not to project proximally beyond the widening bore; and a spring retained between the rod and crossbar so as to yieldably urge the lid into a closed position, said spring extending axially at least to the widening bore.

2. The fuel storage assembly as claimed in claim 1, said lid presenting an inside face and an outside face, said inside face cooperating with the distal margin of the vent body to substantially close the tank when the lid is in the closed position.

3. The fuel storage assembly as claimed in claim 2, said distal margin of the vent body including an axially distal face with an axially extending groove defined therein; and a seal received within the axially extending groove, said lid being disposed against the seal when the lid is in the closed position.

4. The fuel storage assembly as claimed in claim 3, said seal being comprised of elastomeric material.

5. The fuel storage assembly as claimed in claim 1, said vent body including a radially extending groove defined within the chamber and being disposed axially between the proximal and distal margins of the vent body; and a screen element received within the radially extending groove to prevent the introduction of foreign elements into the tank.

6. The fuel storage assembly as claimed in claim 5, said radially extending groove being disposed in general radial alignment with an axially proximal portion of the crossbar.

7. The fuel storage assembly as claimed in claim 5, said radially extending groove being disposed in general radial alignment with an axially distal end of the threaded portion of the proximal margin of the vent body.

8. The fuel storage assembly as claimed in claim 1, said rod comprising a bolt with a radially projecting head and an axially opposed threaded portion, said threaded portion of the bolt being threadably received within a hole defined in an inside face of the lid.

9. The fuel storage assembly as claimed in claim 1, said spring disposed radially around the bolt and being axially constrained between an axially proximal portion of the crossbar and the head of the bolt.

10. The fuel storage assembly as claimed in claim 1, said vent body including a radially outer margin, at least a portion of which being noncircular to facilitate rotating of the body with a tool to threadably insert the proximal margin of the vent body within the flange of the tank.

11. The fuel storage assembly as claimed in claim 10, said noncircular portion being generally polygonal.

12. The fuel storage assembly as claimed in claim 1, said widening bore including a tapered section, along which the diameter of the chamber widens smoothly and continuously.

13. The fuel storage assembly as claimed in claim 12, said tapered section extending from a position disposed in general radial alignment with an axially distal end of the threaded portion of the proximal margin of the vent body to a position along the distal margin of the vent body.

14. The fuel storage assembly as claimed in claim 13, said vent body presenting a distal flow area defined by the radial cross sectional area of the chamber at the distal margin less the area occupied by the rod and crossbar, said vent body presenting a proximal flow area defined by the radial cross sectional area of the chamber at the proximal margin less the area occupied by the rod, said flow areas being substantially equal.

15. The fuel storage assembly as claimed in claim 14, said threaded portion of the proximal margin of the vent body presenting a radial wall thickness dimension defined between an inside wall of the chamber and a root of the thread, said threaded portion of the proximal margin of the vent body presenting a thread depth dimension defined between a crest of the thread and the root of the thread, said radial wall thickness dimension being less than the thread depth dimension.

16. The fuel storage assembly as claimed in claim 15, said radial wall thickness dimension being less than half of the thread depth dimension.

17. The fuel storage assembly as claimed in claim 1, said vent body presenting a distal flow area defined by the radial cross sectional area of the chamber at the distal margin less the area occupied by the rod and crossbar, said vent body presenting a proximal flow area defined by the radial cross sectional area of the chamber at the proximal margin less the area occupied by the rod, said flow areas being substantially equal.

18. The fuel storage assembly as claimed in claim 17, said threaded portion of the proximal margin of the vent body presenting a radial wall thickness dimension defined between an inside wall of the chamber and a root of the thread, said threaded portion of the proximal margin of the vent body presenting a thread depth dimension defined between a crest of the thread and the root of the thread, said radial wall thickness dimension being less than the thread depth dimension.

19. The fuel storage assembly as claimed in claim 18, said radial wall thickness dimension being less than half of the thread depth dimension.

20. A relief vent assembly for use with a fluid holding tank that allows pressurized fluid to flow out from the tank when the pressure inside the tank exceeds a selected level that is greater than the pressure outside the tank, said assembly comprising:

a vent body configured to be operatively secured to a corresponding section of the tank, said vent body defining a generally cylindrical chamber, said vent body presenting an axially proximal margin and an axially distal margin, said vent body including a supporting crossbar generally radially spanning the chamber;

a lid generally axially surmounting the axially distal margin of the vent body;

a rod projecting axially proximally from the lid, said supporting crossbar including a generally centrally disposed hole defined axially therethrough, said rod projecting through the hole in the crossbar such that the crossbar radially supports and axially aligns the rod, said crossbar including an axially distal portion that is generally coplanar with the axially distal margin of the vent body, said cylindrical chamber including a widening bore having a cross-sectional dimension that progressively increases distally, said crossbar projecting across and being located within the widening bore so as not to project proximally beyond the widening bore; and a spring retained between the rod and crossbar so as to yieldably urge the lid into a closed position, said spring extending axially at least to the widening bore.

21. The relief vent assembly as claimed in claim 20,
said distal margin of the vent body including an axially distal face with an axially extending groove defined therein; and
a seal received within the axially extending groove,
said lid being disposed against the seal when the lid is in the closed position.

22. The relief vent assembly as claimed in claim 21,
said seal being comprised of elastomeric material.

23. The relief vent assembly as claimed in claim 22,
said vent body including a radially extending groove defined within the chamber and being disposed axially between the proximal and distal margins of the vent body; and
a screen element received within the radially extending groove to prevent the introduction of foreign elements into the tank.

24. The relief vent assembly as claimed in claim 23,
said radially extending groove being disposed in general radial alignment with an axially proximal portion of the crossbar.

25. The relief vent assembly as claimed in claim 23,
said radially extending groove being disposed in general radial alignment with an axially distal end of the threaded portion of the radially outer margin of the vent body.

26. The relief vent assembly as claimed in claim 20,
said rod comprising a bolt with a radially projecting head and an axially opposed threaded portion,
said threaded portion of the bolt being threadably received within a hole defined in an inside face of the lid.

27. The relief vent assembly as claimed in claim 20,
said spring disposed radially around the bolt and being axially constrained between an axially proximal portion of the crossbar and the head of the bolt.

28. The relief vent assembly as claimed in claim 20,
said vent body including a radially outer margin, a portion of which adjacent the axially proximal margin being externally threaded and configured for being threadably received within a flange of the tank,
said radially outer margin of the vent body including at least a portion being noncircular to facilitate rotating of the body with a tool to threadably insert the proximal margin of the vent body within the flange of the tank.

29. The relief vent assembly as claimed in claim 28,
said noncircular portion being generally polygonal.

30. The relief vent assembly as claimed in claim 20,
said widening bore including a tapered section, along which the diameter of the chamber widens smoothly and continuously.

31. The relief vent assembly as claimed in claim 30,
said vent body including a radially outer margin, a portion of which adjacent the axially proximal margin being externally threaded and configured for being threadably received within a flange of the tank,
said tapered section extending from a position disposed in general radial alignment with an axially distal end of the threaded portion of the radially outer margin of the vent body to a position along the distal margin of the vent body.

32. The relief vent assembly as claimed in claim 31,
said vent body presenting a distal flow area defined by the radial cross sectional area of the chamber at the distal margin less the area occupied by the rod and crossbar,
said vent body presenting a proximal flow area defined by the radial cross sectional area of the chamber at the proximal margin less the area occupied by the rod,
said flow areas being substantially equal.

33. The relief vent assembly as claimed in claim 32,
said threaded portion of the radially outer margin of the vent body presenting a radial wall thickness dimension defined between an inside wall of the chamber and a root of the thread,
said threaded portion of the proximal margin of the vent body presenting a thread depth dimension defined between a crest of the thread and the root of the thread,
said radial wall thickness dimension being less than the thread depth dimension.

34. The relief vent assembly as claimed in claim 33,
said radial wall thickness dimension being less than half of the thread depth dimension.

35. The relief vent assembly as claimed in claim 20,
said vent body presenting a distal flow area defined by the radial cross sectional area of the chamber at the distal margin less the area occupied by the rod and crossbar,
said vent body presenting a proximal flow area defined by the radial cross sectional area of the chamber at the proximal margin less the area occupied by the rod,
said flow areas being substantially equal.

36. The relief vent assembly as claimed in claim 35,
said vent body including a radially outer margin, a portion of which adjacent the axially proximal margin being externally threaded and configured for being threadably received within a flange of the tank,
said threaded portion of the radially outer margin of the vent body presenting a radial wall thickness dimension defined between an inside wall of the chamber and a root of the thread,
said threaded portion of the proximal margin of the vent body presenting a thread depth dimension defined between a crest of the thread and the root of the thread,
said radial wall thickness dimension being less than the thread depth dimension.

37. The relief vent assembly as claimed in claim 36,
said radial wall thickness dimension being less than half of the thread depth dimension.

38. A relief vent assembly for use with a fluid holding tank that allows pressurized fluid to flow out from the tank when the pressure inside the tank exceeds a selected level that is greater than the pressure outside the tank, said assembly comprising:
a vent body configured to be operatively secured to a corresponding section of the tank,
said vent body defining a chamber,
said vent body presenting an axially proximal margin and an axially distal margin,
said vent body including a supporting crossbar extending across the chamber;
a lid generally axially surmounting the axially distal margin of the vent body;
a rod projecting axially proximally from the lid,
said supporting crossbar including a generally centrally disposed hole defined axially therethrough,
said rod projecting through the hole in the crossbar such that the crossbar laterally supports and axially aligns the rod,
said chamber including a widening bore having a cross-sectional dimension that increases distally,
said widening bore being located generally closer to the distal margin than the proximal margin,
said crossbar projecting across and being located within the widening bore so as not to project proximally beyond the widening bore; and
a spring retained between the rod and crossbar so as to yieldably urge the lid into a closed position,
said spring extending axially at least to the widening bore.

* * * * *